US009834981B2

(12) United States Patent
Sadeli

(10) Patent No.: US 9,834,981 B2
(45) Date of Patent: Dec. 5, 2017

(54) DOOR COMPONENT AND DOOR WITH LAMINATED STRENGTHENING BARS

(71) Applicant: PT Kayu Permata, Bekasi (ID)

(72) Inventor: Bhakti Sadeli, Bekasi (ID)

(73) Assignee: PT KAYU PERMATA, Bekasi (ID)

( * ) Notice: Subject to any disclaimer, the term of this patent is extended or adjusted under 35 U.S.C. 154(b) by 0 days.

(21) Appl. No.: 15/614,074

(22) Filed: Jun. 5, 2017

(65) Prior Publication Data

US 2017/0268288 A1 Sep. 21, 2017

Related U.S. Application Data

(62) Division of application No. 15/065,007, filed on Mar. 9, 2016, now Pat. No. 9,683,405.

(30) Foreign Application Priority Data

Mar. 10, 2015 (GB) ..... 1504030.6

(51) Int. Cl.
*E06B 3/70* (2006.01)

(52) U.S. Cl.
CPC .... *E06B 3/7001* (2013.01); *E06B 2003/7023* (2013.01); *E06B 2003/7051* (2013.01); *E06B 2003/7063* (2013.01); *E06B 2003/7067* (2013.01); *E06B 2003/7069* (2013.01)

(58) Field of Classification Search
CPC ..... E06B 3/7015; E06B 3/74; E06B 3/263; E06B 2003/7021; E06B 2003/7023; E06B 2003/7071; E06B 2003/7067; E06B 2003/7051; E06B 2003/7063; E06B 2003/7069
USPC ..... 52/784.15
See application file for complete search history.

(56) References Cited

U.S. PATENT DOCUMENTS

| | | | |
|---|---|---|---|
| 2,040,259 | A | 5/1936 | Johnson |
| 3,121,264 | A | 2/1964 | Hammar |
| 5,743,057 | A | 3/1998 | Martin |
| 5,944,928 | A | 8/1999 | Seidner |
| 6,066,222 | A | 5/2000 | Fulford |
| 6,217,976 | B1 | 3/2001 | Macpherson et al. |
| 7,721,500 | B2 | 5/2010 | Clark et al. |
| 8,927,085 | B2 | 1/2015 | Burton |
| 2003/0033786 | A1 | 2/2003 | Yulkowski |
| 2003/0200714 | A1 | 10/2003 | Minke et al. |
| 2005/0252126 | A1 | 11/2005 | Chan |
| 2007/0125043 | A1 | 6/2007 | Clark et al. |
| 2007/0193220 | A1 | 8/2007 | Daniels |
| 2009/0038261 | A1 | 2/2009 | Lee et al. |
| 2012/0231210 | A1 | 9/2012 | Handojo |

FOREIGN PATENT DOCUMENTS

| | | | |
|---|---|---|---|
| CA | 2454014 | A1 | 7/2004 |
| CA | 2699818 | A1 | 10/2010 |
| CA | 2879604 | A1 | 1/2014 |

(Continued)

*Primary Examiner* — Babajide Demuren
(74) *Attorney, Agent, or Firm* — Coats and Bennett, PLLC

(57) ABSTRACT

A door component, a door, and a method for manufacturing the same. The door may be an external domestic door. The door component includes a thermally insulating material sandwiched by a first layer and a second layer. The component has at least one strengthening bar sandwiched by the first and second layers. The first and second layers are cross-laminated plywood. The strengthening bar(s) are advantageously cross-laminated. Related doors and methods of manufacture are disclosed.

12 Claims, 18 Drawing Sheets

(56) References Cited

FOREIGN PATENT DOCUMENTS

| | | | |
|---|---|---|---|
| CN | 201933966 | U | 8/2011 |
| DE | 2422680 | A1 | 11/1975 |
| DE | 3105521 | A1 | 11/1982 |
| DE | 19935199 | A1 | 12/2002 |
| EP | 0513605 | A1 | 4/1992 |
| EP | 0756059 | A1 | 1/1997 |
| EP | 1647659 | A1 | 4/2006 |
| EP | 1862632 | A1 | 12/2007 |
| FR | 1431029 | A | 3/1966 |
| FR | 2063725 | A5 | 7/1971 |
| GB | 553622 | A | 5/1943 |
| GB | 1067480 | | 5/1967 |
| GB | 2022668 | A | 12/1979 |
| WO | 9101878 | A1 | 2/1991 |

Section A-A

Section B-B

Section C-C

Section 1

Section 2

Section 3

Section 4

Section A-A

Section B-B

Section C-C

DOOR COMPONENT AND DOOR WITH LAMINATED STRENGTHENING BARS

This application is a divisional of prior U.S. patent application Ser. No. 15/065,007, filed on 9 Mar. 2016, and claims the benefit of United Kingdom application 1504030.6, filed on 10 Mar. 2015, the disclosures of all of which are incorporated herein by reference in their entirety.

BACKGROUND

The present invention relates to a door component, a related door, and to a method for manufacturing the same. The door may advantageously be an external domestic door.

There are various types of doors and methods for manufacturing them known in the door manufacturing industry, and the present invention is of particular relevance to what is commonly referred to as an external domestic door, preferably in both contemporary and traditional stiles and rails door designs.

A problem associated with the construction of external domestic doors is that it is challenging to achieve improved thermal insulation performance that complies with the governmental building regulations, while maintaining structural integrity and security. The design of a door component, particularly the door core, should be considered in meeting those requirements.

Most existing timber door cores typically comprise a solid timber core with plywood skins, while traditional stiles and rails doors comprise a solid timber core secured within a frame formed of rails and stiles, with only the panels being thermally insulated by way of polystyrene foam sandwiched between plywood. In both types of construction, preferably a decorative surface veneer can be added for aesthetic purposes.

Various building regulations or consumer demand encourage external doors to be energy efficient; and, in order to comply with those requirements, existing timber rail and stile doors are produced with insulating foam sandwiched only in the door panels. However, this compromises the structural integrity and security of the door and does not maximize thermal insulation properties across the door. Thus, there remains a need for alternative approaches to door and door component design.

SUMMARY

A method of engineering/combining together substantially rigid insulating foam with either timber or plywood to produce a door component, particularly a door core, is presented hereinafter.

A first aspect of the present invention provides a door component comprising a thermally insulating material, such as insulating foam, sandwiched by a first layer and a second layer; the component includes at least one strengthening bar.

An advantage of the present invention over the prior art is that the combination of the layers together with the strengthening bar and insulating material helps to improve thermal performance while ensuring enhanced structural stability and security. In particular, one or both of the outer layers may be formed from ply boards (also called plywood boards) and the strengthening bar may be formed from ply material. Cross lamination of the outer ply boards together with the cross laminated strengthening bar(s), which are distributed within the door component with insulating material, can be helpful in improving stability and security of the door component and a door fabricated from, or including, such a door component. Ply board is a known material made by laminating sheets, particularly wood sheets, together to form a board.

The first and second layers are preferably formed by substantially planar boards, particularly ply boards which may be cross ply boards, which may be arranged such that they are substantially parallel to one another. The plane of the boards may extend in a longitudinal direction and a lateral direction, perpendicular to the longitudinal direction. The boards may be offset in a depth direction perpendicular to the boards.

The at least one strengthening bar is preferably sandwiched by, and makes contact with, each of the first and second layers. The first and second layers may be bonded, or otherwise attached, to the, or each, strengthening bar, for example by gluing. The strengthening bar may extend across the door component substantially parallel with the lateral direction. The strengthening bar preferably extends substantially continuously from adjacent one edge to adjacent an opposing, second, edge of the door component.

In an embodiment, a door component according to the invention comprises a cross laminated strengthening bar reinforced thermally insulating material which is sandwiched between cross laminated LVB (Laminated Veneer Board) plywood boards. The material used in the door component will be named hereafter as Cross Laminated Ply-Foam (CLPF).

The at least one strengthening bar is preferably an engineered wood product made of cross-laminated LVL (Laminated Veneer Lumber) with a grain preferably extending in a grain direction, which may be aligned to be substantially parallel with the longitudinal direction. The height of at least one strengthening bar in the longitudinal direction is preferably between about 25 mm to 45 mm, more preferably between about 30 mm to 40 mm, and most preferably substantially 35 mm. The depth of the at least one strengthening bar in the depth direction is preferably between about 10 mm to 40 mm, more preferably between about 15 mm to 35 mm, and most preferably substantially 20 mm to 30 mm. As noted above, the width of the strengthening bar in the lateral direction may be substantially equal to the lateral extent of the boards. The offset between the first and second layers preferably substantially matches the depth (in a direction perpendicular to the first and second layers) of the at least one strengthening bar, particularly in an embodiment in which the layers are attached to opposing sides of the at least one strengthening bar. In embodiments in which more than one strengthening bar is included, it is preferred that all strengthening bars have substantially the same depth. In embodiments in which more than one strengthening bar is included it is preferred if all strengthening bars have substantially the same height (in a direction parallel to the first and second layers, and perpendicular to the longitudinal axis of the strengthening bar).

A traditional door may comprise rails, stiles and panels (as shown in FIG. 3). The use of a CLPF door component in such a door enables the insulating foam to be included, not only in the panels, but also in rails and stiles, thus providing enhanced thermal insulation performance. Such a significant inclusion of insulating foam could compromise the strength and security of a door, but the use of a CLPF door component has been found to provide sufficient strength to the door, while providing enhanced thermal insulation. For example, a door comprising a door component according to this invention may have a U value (heat transfer coefficient) of less than about 1.5 to 2.0 $W/m^2K$.

The thermally insulating material may be provided in any form. The thermally insulating material may be provided as a plurality of elongate blocks of foam material. Ideally, the plurality of elongate blocks are arranged parallel to one another, with neighboring blocks separated from one another by at least one strengthening bar, preferably by one strengthening bar. Each of the plurality of elongate blocks may extend continuously from a position adjacent a first edge of the door component to a position adjacent a second edge of the door component, wherein the first edge is opposite the second edge. It will be appreciated that at least one, some, or all of the elongate blocks may extend from, or to, a position adjacent an edge of the door component which is recessed from the edge by about 5 mm to 10 mm. At least one, some, or all of the elongate blocks may extend from, or to, a position adjacent an edge of the door component which is substantially aligned with the edge of the door component.

At least one, and preferably each, of the plurality of elongate blocks may have a uniform cross-sectional size and shape along the entire length of the block. Ideally, the shape is rectilinear and preferably is a rectilinear polygon, and more preferably is a square or rectangle. Each of the plurality of elongate blocks may be located with an interference fit between the first and second layers. In this way, the blocks tend to be held in position between the layers. Furthermore, each of the plurality of elongate blocks may be compressed by the remainder of the door component and/or may be compressed by the first and second layers. For example, the foam blocks may have a depth in the depth direction which is substantially equal to, or slightly greater than, the depth of the at least one strengthening bar.

It is preferable that the arrangement of the first and second layers with the or each strengthening bar is such as to provide at least one elongate cavity into which an elongate block may be arranged, for example by being pushed from one end of the cavity to an opposite end thereof. The or each cavity may have a uniform cross-sectional size and shape along its length which is substantially the same as that of the respective elongate block to be received in the cavity.

The at least one strengthening bar preferably has a greater stiffness than the thermally insulating material.

As noted above, the door component can be used in the manufacture of a door. The door component can be used to manufacture parts of the door, or can be used as a door core. A second aspect of the invention therefore provides a door comprising a door component as set out above. It should be noted that a door component may be fabricated by creating a precursor component which can be cut to a desired size and/or shape and may have openings cut therein to receive further components which will make up a door.

A third aspect of the present invention provides a method of manufacturing a door component, wherein the door component is as described above. The method may comprise:

a. Arranging the first and second layers with the or each strengthening bar so as to provide at least one elongate cavity into which an elongate block may be pushed; and
b. Thereafter, pushing an elongate block into at least one elongate cavity.

This process allows the first and second layers to be attached to the strengthening bars to provide a carcass into which the insulating material can be added.

In an alternative method the method comprises:

a. Providing a first layer on which is arranged the or each strengthening bar so as to provide at least one elongate cavity into which an elongate block may be arranged;
b. Arranging an elongate block into at least one elongate cavity; and
c. Arranging the second layer so as to sandwich the strengthening bar and thermally insulating material.

A fourth aspect of the present invention provides a method of manufacturing a door, comprising:

1. Providing a door core manufactured from a door component;
2. Framing the door core by securing a frame to the edges of the door core;
3. Securing a decorative layer to substantially cover each of the exposed layers of the door component; and
4. Thereafter, machining at least one structure into a surface of the decorative layer.

Another aspect of the invention provides a door component comprising a thermally insulating material sandwiched by a first plywood layer and a second plywood layer; the component being characterized in that the first and second plywood layers are separated by a plurality of strengthening bars, the strengthening bars being a laminated wood product, the strengthening bars and first and second layers forming cavities extending from a first edge of the first plywood layer to a second edge of the first plywood layer, the second edge being opposite the first edge.

It has been found that a door component as set out above provides a convenient manufacturing method and the use of the laminated materials, preferably some, or all, being cross laminated, set out above provide a door component that is sufficiently strong that transverse strengthening bars that run transverse to the strengthening bars are not required.

The strength of the door component is such that it can be used as a door core for the formation of a door blank in a method including the steps of:

1. Providing a door core manufactured from a door component;
2. Framing the door core by securing a frame to at least some, preferably all, of the edges of the door core; and
3. Securing a decorative layer to substantially cover each of the exposed layers of the door component.

The decorative layer may be a wood veneer, for example oak, but could also be a glass reinforced plastic (GRP) door skin, or other decorative layer. The decorative layer may also serve a function other than decorative, for example, it may enhance the structural integrity of the door, the weather resistance of the door and/or the thermal insulation of the door.

Such a door blank can be further processed, for example by CNC machining, such that it includes further decorative or functional features. The use of such a door component in such a process to manufacture a door facilitates the construction of a joint-less door having acceptable structural and thermal properties.

A similar process can be used in the manufacture of parts of a door, for example the construction of a stile, rail, or panel, the process comprising:

1. Providing a door component of an appropriate size;
2. Framing the door component by securing a frame to at least some, preferably all, of the edges of the door component; and
3. Securing a decorative layer to substantially cover each of the exposed layers of the door component.

Such a process facilitates the construction of elements, or parts of a door, having acceptable structural and thermal properties.

DETAILED DESCRIPTION

Figure 1:
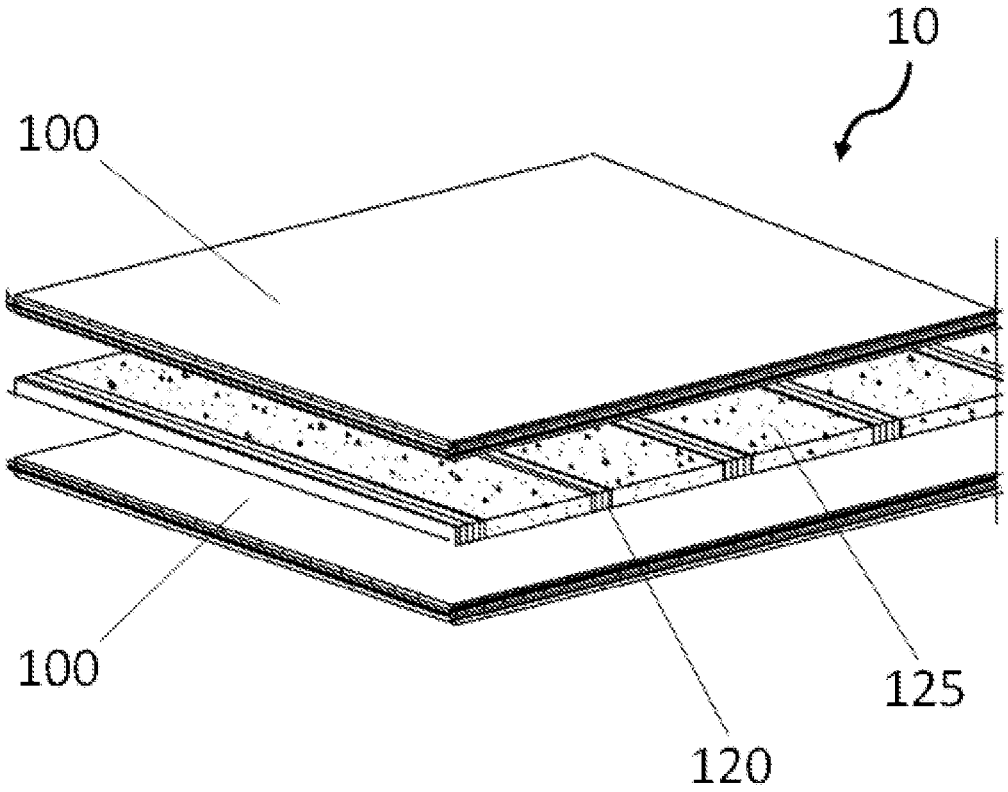
FIG. 1 is a schematic perspective view of a first embodiment of a door component according to the present invention.
Figure 2:
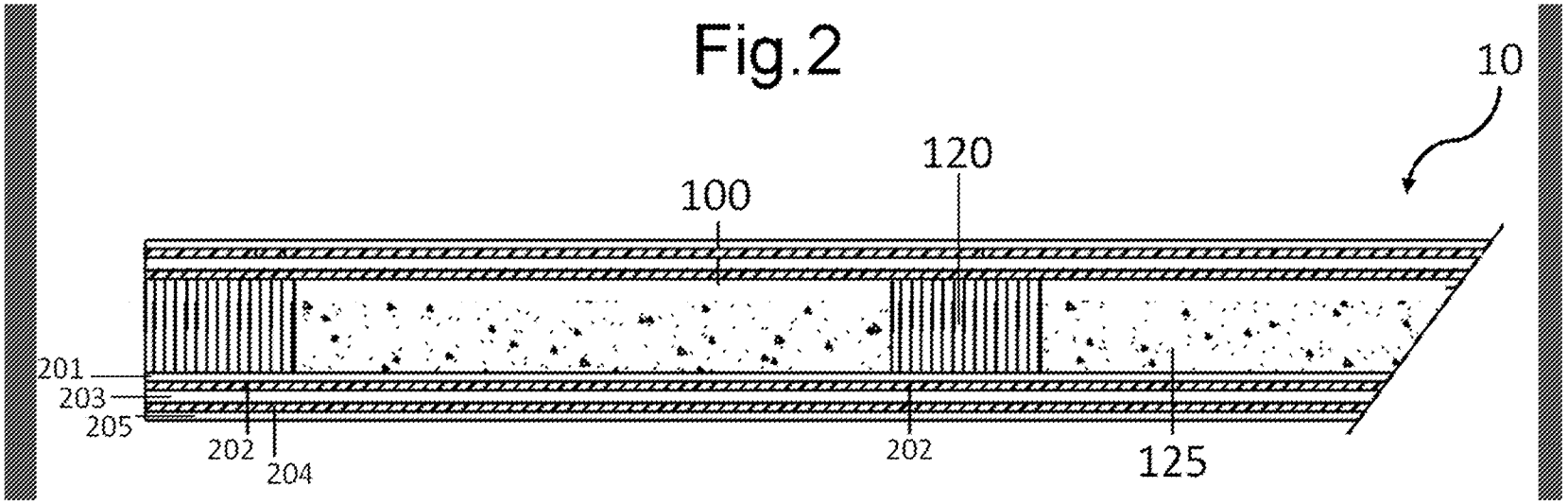
FIG. 2 is a cross-sectional view of the first embodiment of FIG. 1.

A schematic perspective view of an embodiment of the present invention is shown in FIG. 1 in the form of a Cross Laminated Ply-Foam (CLPF) core 10 (the CLPF core is a door component of the invention) wherein LVB (Laminated Veneer Board) Water and Boil Proof (WBP) hardwood ply boards (or outer boards/panels or layers) 100 are combined with thermal insulating substantially rigid foam sheets/blocks 125 and cross laminated strengthening bars 120. A cross-sectional view of the CLPF core is shown in FIG. 2. The outer boards 100 of the CLPF core 10 are laminates and comprised of five laminate sheets, but it will be appreciated that other numbers of laminate sheets could be used instead. In the illustrated embodiment, the laminate sheets are all WBP ply board, but in other embodiments (not shown), the laminate sheets can be made of other suitable materials such as Albezia timber LVB plywood.

Figure 3:
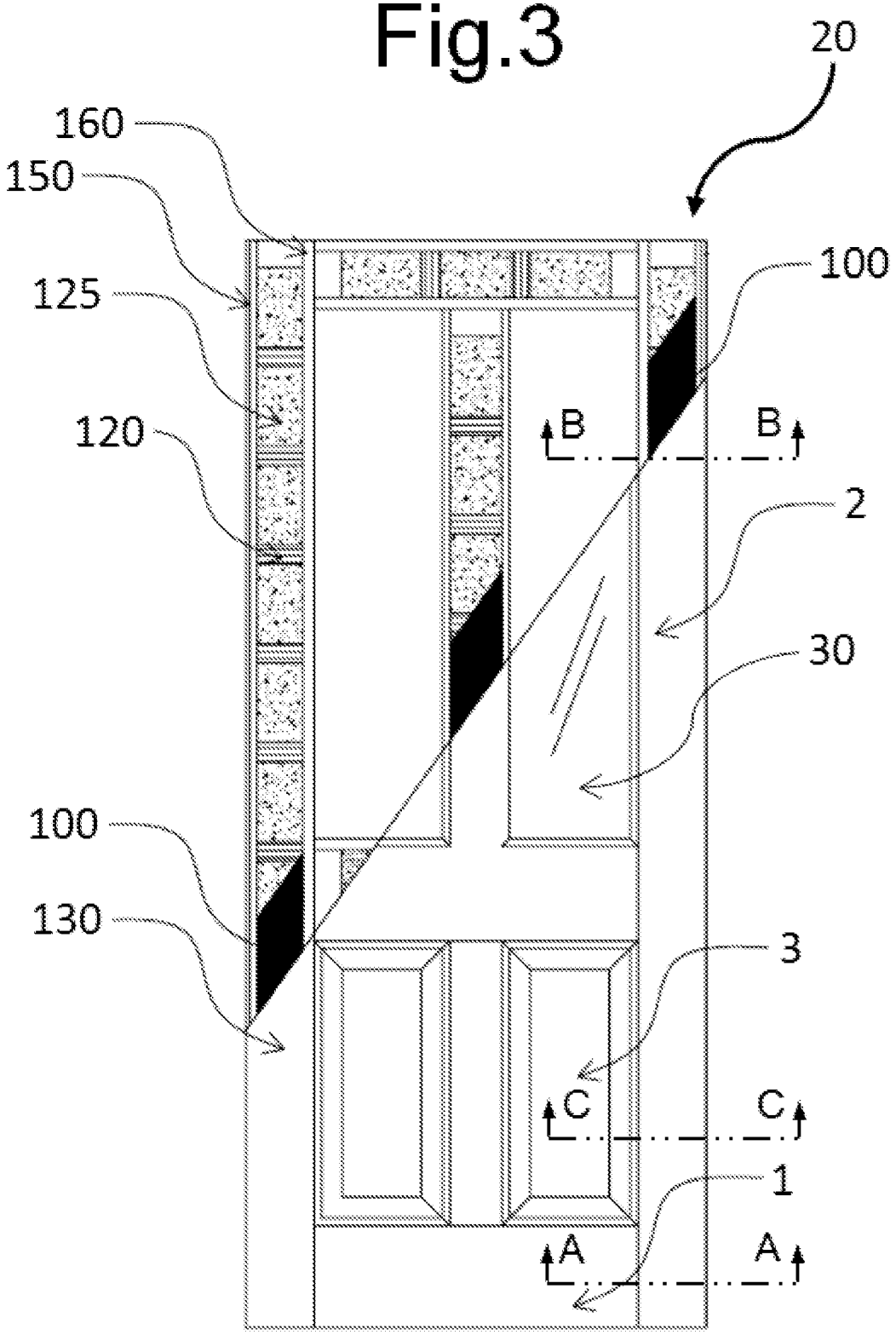
FIG. 3 is a cut-away front view of a door comprising the first embodiment with a Derby stiles and rails door design.

The laminate sheets of the outer boards 100 are compressed, glued, laminated together, and finally furnished with cross banded veneer applied horizontally for a high quality decorative finish. The five ply sheets are cross laminated with three wood laminate sheets with grain in a first direction separated with two laminate sheets with grain in a second direction, substantially perpendicular to the first direction. Here the three laminate sheets 201, 203, and 205 (marked in FIG. 2) have a grain in a first direction, while the remaining two laminate sheets 202 and 204 have a grain in a second direction, substantially perpendicular to the first direction. When arranged in a use position in a hung door, as shown in FIG. 3 the first direction may be substantially vertical. It will be understood that the strength and stability of the core construction are improved by such cross lamination of the outer plywood laminate sheets. Embodiments that have a LVB lamination benefit from having even greater strength, because the LVB lamination prevents relative movement between parts of the core construction. The LVB lamination may have a vertical grain direction. A variation of the inclination angle of the grain is also possible.

In the illustrated embodiment, the center of the CLPF core 10 is filled with substantially rigid sheets/blocks 125 of insulating foam. The insulating foam material may be preferably substantially synthetic material for example polystyrene, more preferably solid extruded polystyrene, and most preferably STYROFOAM RTM-GV-NC-X™ extruded polystyrene. The foam sheets 125 are arranged with a configuration so as to extend horizontally (when arranged in a use position in a hung door). The foam sheets/boards 125 are 140-145 mm tall, but alternative heights may be used and the sheets may also be arranged with a different configuration (e.g., at an inclination relative to horizontal). The length of the insulating foam sheets is such that the foam extends from adjacent a first edge of the outer boards 100 to adjacent a second edge of the outer boards 100. The second edge is opposite the first edge (e.g., see FIG. 3). It will be appreciated that other insulating materials can be used in place of or in addition to the rigid foam sheets.

In the present embodiment, neighboring foam sheets 125 are separated from one another by strengthening bars 120, which are in this case cross laminated. The strengthening bars are 35 mm in height. Variations in this size are possible. The length of the strengthening bars 120 is such that the bars extends from adjacent a first edge of the outer boards 100 to adjacent a second edge of the outer boards 100. The second edge is opposite the first edge. In the illustrated embodiment, the strengthening bars 120 are equally spaced apart across the vertical length of the door (when arranged in a use position in a hung door). However, it will be appreciated that the strengthening bars can be unequally spaced along the length of the door 20. The number of strengthening bars 120 across the vertical height of the door (as described above) is preferably between six and fourteen, more preferably between eight and twelve, and most preferably eleven. Preferably, the strengthening bars are spaced apart by between about 100 mm to 200 mm, more preferably between about 130 mm to 160 mm. In an embodiment, the strengthening bars are substantially equally spaced apart by about 145 mm. It should be noted that a preferred range of 140-145 mm has been found to provide among the best U values (heat transfer coefficients) while still maintaining the structural strength and stability of a door.

Figure 4:
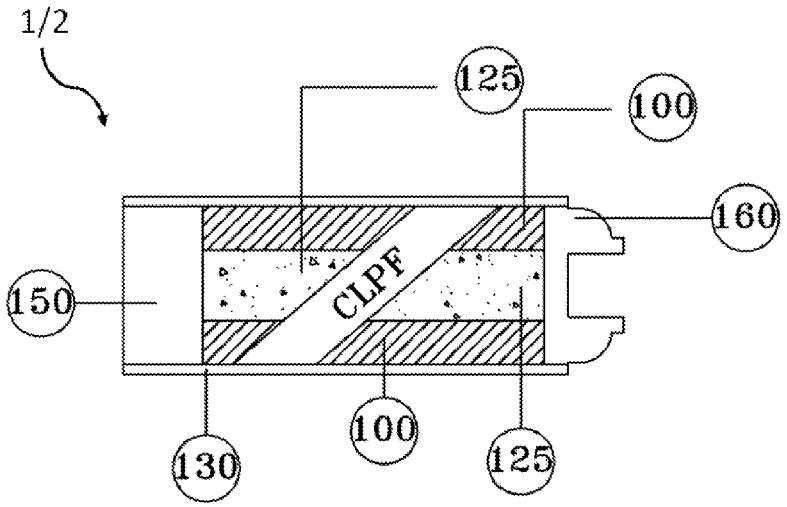
FIG. 4 is a cross-sectional (A-A) view of a rail (or a stile) of a door comprising the first embodiment.
Figure 4A:
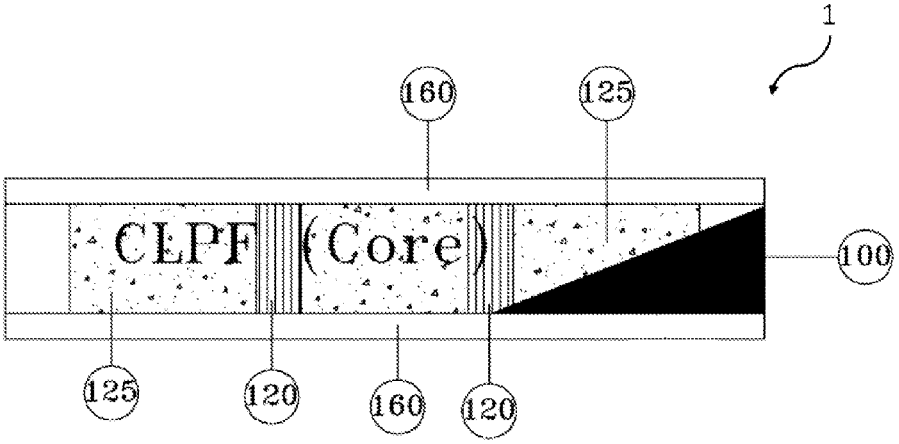
FIG. 4*a* is front view of a rail of a door comprising the first embodiment.
Figure 5:
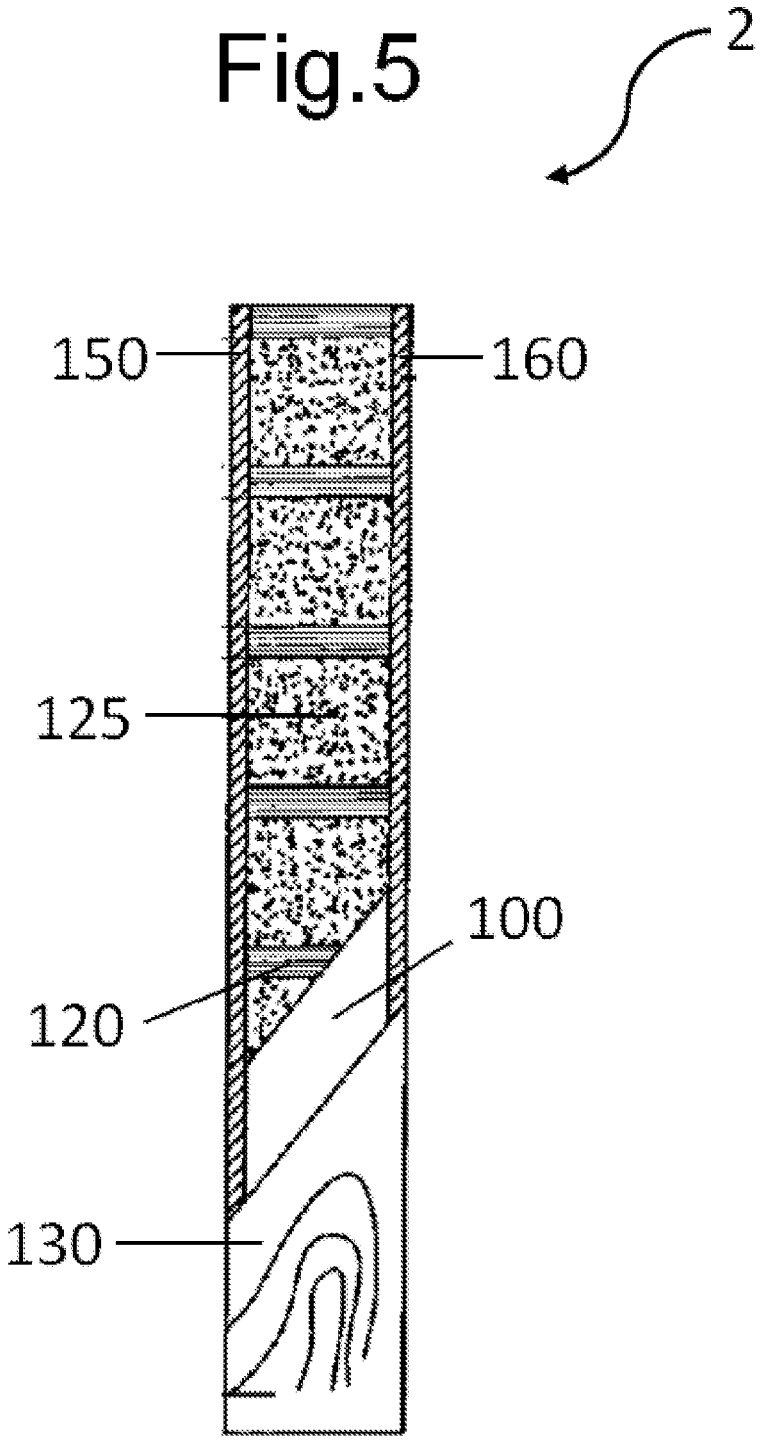
FIG. 5 is a front view of a stile of a door comprising the first embodiment.
Figure 6:
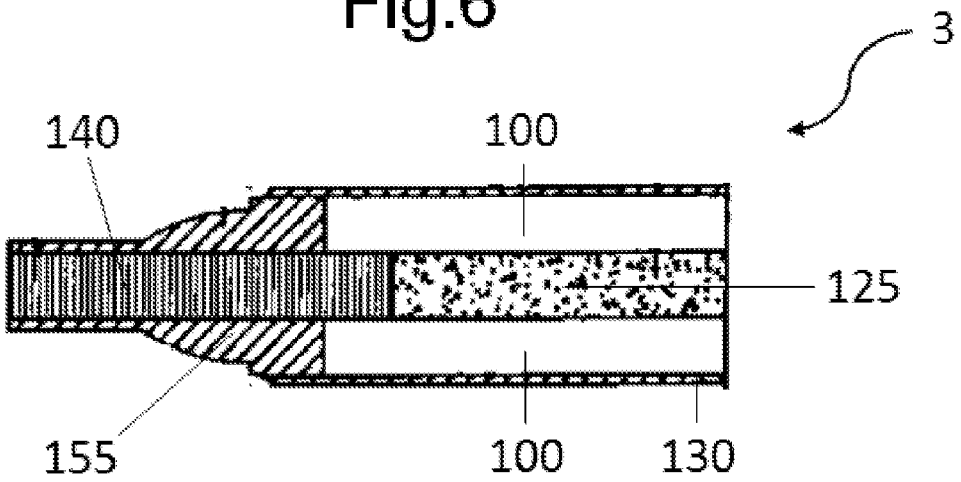
FIG. 6 is a cross-sectional (C-C) view of a panel of a door comprising the first embodiment.
Figure 8:
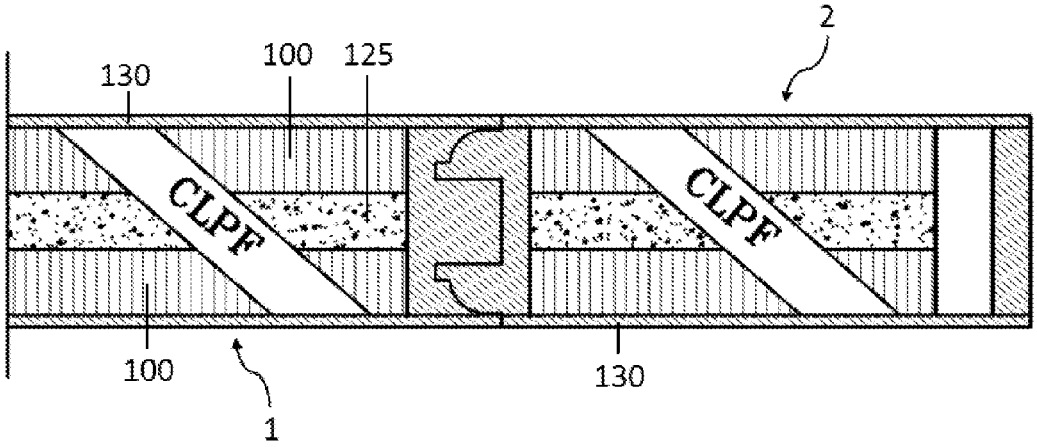
FIG. 8 is the cross-section A-A of a door shown in the embodiment of FIG. 3.
Figure 9:
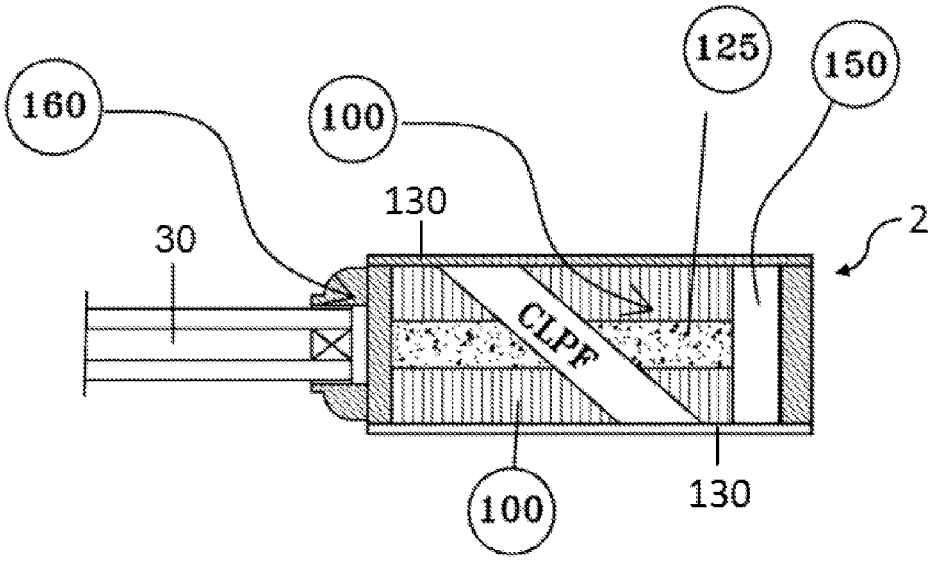
FIG. 9 is the cross-section B-B of a door shown in the embodiment of FIG. 3.
Figure 10:
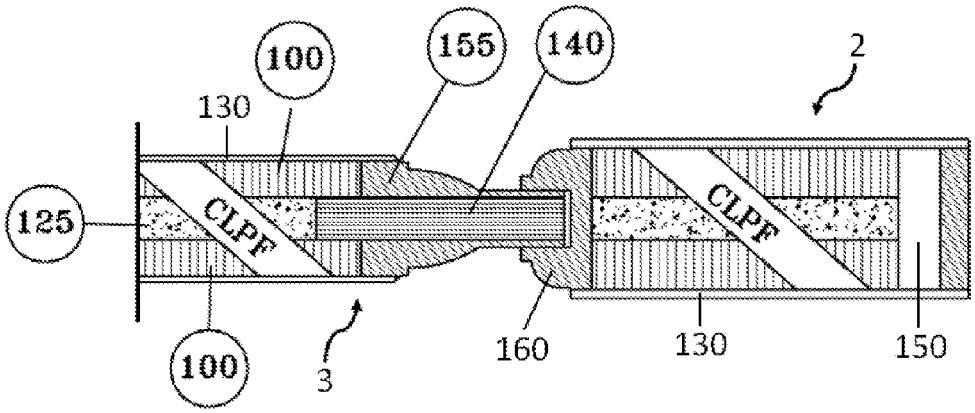
FIG. 10 is the cross-section C-C of a door shown in the embodiment of FIG. 3.

FIG. 3 is a cut-away front view of a door 20 comprising the first embodiment with a traditional Derby stiles and rails door design. FIGS. 4 and 6 respectively show a cross-sectional view of a rail 1 (or stile 2) and a panel 3 of the door as shown in FIG. 3. FIG. 4*a* and FIG. 5 show respectively a front view of a rail 1 and a stile 2 of the door 20 shown in FIG. 3. FIG. 8, FIG. 9 and FIG. 10 show respectively the views of the cross-section A-A of a rail 1, the cross-section B-B of a stile 2 and the cross-section C-C a panel 3 of the door 20 shown in the embodiment of FIG. 3.

As shown in FIG. 4, the rail 1 (or stile 2) comprises insulating foam sheets/blocks 125 sandwiched between outer plywood boards 100. In the assembled door 20, the rail 1 or stile 2 is framed, in this case with solid wood 150 around the (typically, four) edges of the boards 100 (see FIG. 3). In an assembled door 20, a decorative veneer 130, for example a cross banded veneer, is optionally provided on to the outer plane surfaces of the door boards 100, and over the solid timber edges, and it may be installed with a vertical grain direction. The decorative veneer may be any suitable veneer, for example an oak veneer, but it will be appreciated that other materials can be used in place of the outer decorative oak veneer and could be a synthetic material, for example a glass reinforced plastic (GRP) material.

Figure 7:
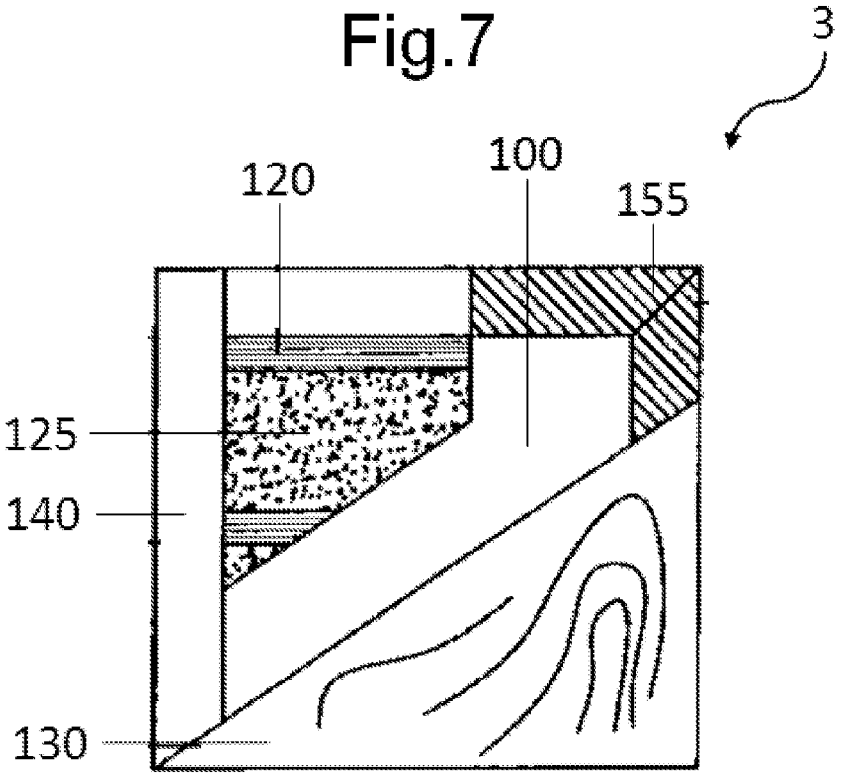
FIG. 7 is a partial cut-away front view of a panel of a door comprising the first embodiment.

As shown in FIGS. 6 and 7, a panel 3 comprises insulating foam 125 sandwiched between outer plywood boards 100. The panel 3 further comprises a wooden block 140 that abuts one end of a foam block 125. A frame 155 sandwiches a portion of the wooded block 140. The panel optionally comprises a decorative oak veneer 130 as mentioned forth above.

The rail 1 (or stile 2) further comprises a structure 160 along one edge of the rail 1 (or stile 2) (see FIG. 4). The structure 160 includes a recess. A complementary protrusion is provided on the panel 3 shown in FIG. 6. In this embodiment, the protrusion is provided by the wooden block 140 that is partially sandwiched between the outer plywood boards 100. One end of the wooden block 140 extends beyond the outer plywood boards 100 to provide the protrusion.

A door 20 as shown in FIG. 3 is assembled by securing together a plurality of rails 1, stiles 2 and panels 3 that are manufactured separately. For example, in the embodiment shown in FIG. 8, a rail 1 and a stile 2 are secured in a friction fit, preferably but not exclusively with dowels. Equally, a stile 2 and a panel 3 may be secured by fitting together the recess 160 and the protrusion in a friction fit (see FIG. 10). A glass panel 30 can be fitted between the rail and panel in a friction fit as shown in FIG. 9. Preferably, an adhesive and, or a silicone may be used to supplement the friction fit.

Figure 11:
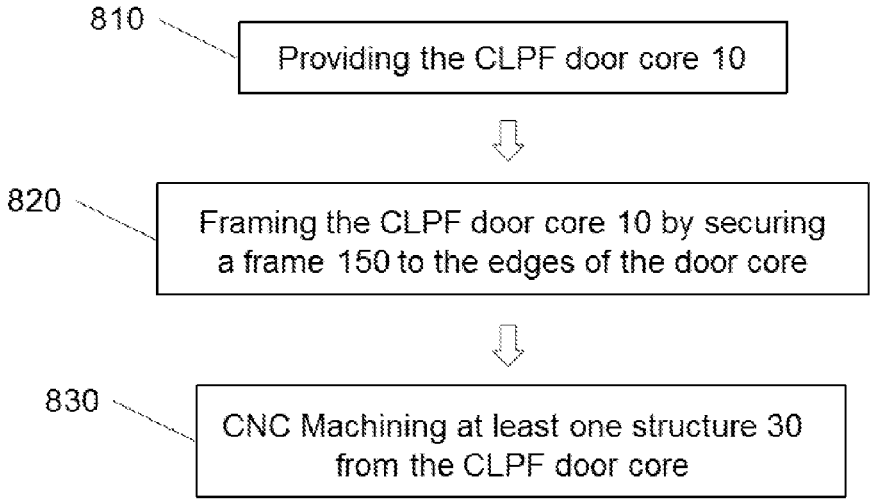
FIG. 11 is a flow diagram showing a method of manufacturing a joint-less door.

A method of manufacturing a door component, in particular, a joint-less door, is described below in FIG. 11 with reference to FIGS. 12 to 17.

Figure 12:
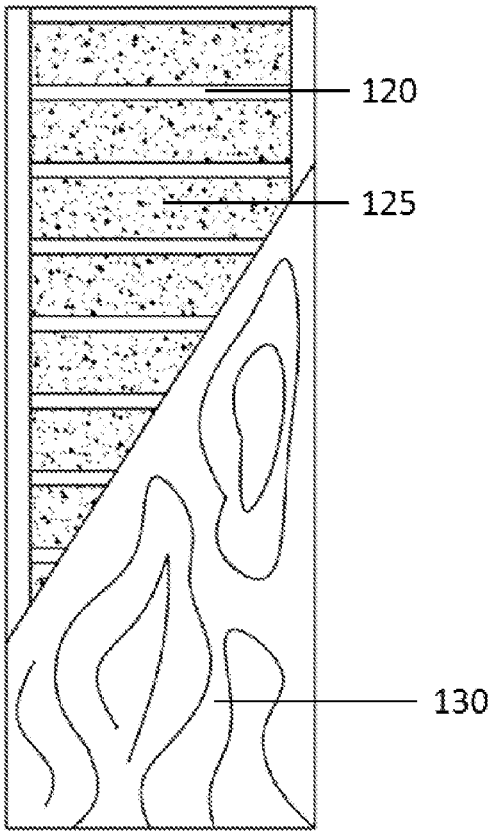
FIG. 12 is a cut-away front view of a door core comprising the first embodiment.
Figure 13:
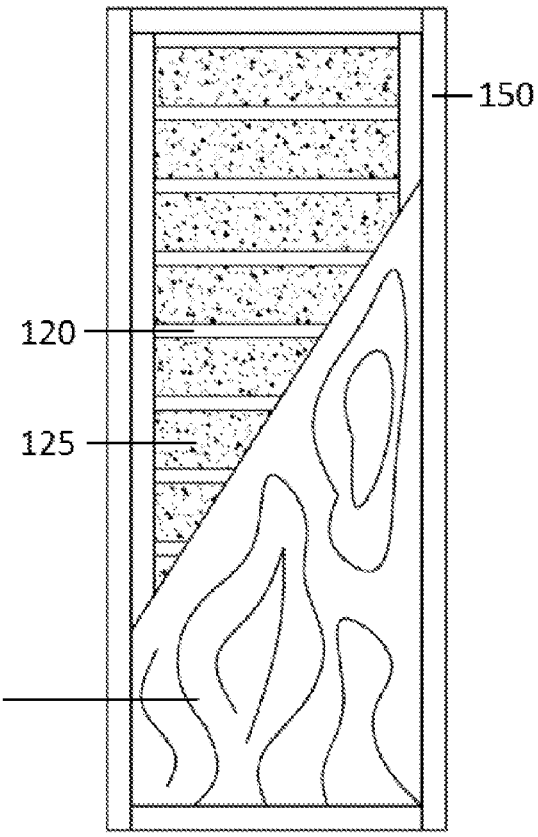
FIG. 13 is a cut-away front view of a door core comprising the first embodiment framed with a frame.

In a first step 810, a CLPF core 10 as shown in FIG. 12 is provided. The CLPF core 10 comprises the abovementioned insulating foam 125, strengthening bars 120 and outer plywood boards 100 (not shown for clarity). A decorative oak veneer 130, for example a cross banded veneer, is optionally provided on to the outer plane surfaces of the door boards 100, and over the solid timber edges, and it may be installed in a vertical grain direction. It will be appreciated that other materials can be used in place of the outer decorative oak veneer.

In a second step 820, the CLPF core 10 is framed preferably with solid wood 150 around the (typically, four) edges of the boards 100. This is as shown for example in FIG. 13.

In a third step 830, an aesthetic surface design 30 for the framed CLPF core construction, as described in step 820, is machined into the outer exposed plywood veneered face. This is ideally achieved with Computer Numerical Control (CNC) machining. CNC machining can be applied to manufacture traditional and even complex door designs with high precision. For example, CNC machining may be used preferably to cut out panels with different surface designs 30 from the CLPF door core 10, to create additional panels 30 to be fitted in the CLPF door core 10, or to cut through the door core 10 so that to provide openings comprising glazing beads where glass panels 30 can be fitted therein. It will be understood that the joint-less door design allows an improvement to be made to the performance and endurance of a door by minimizing potential risks of joints opening and panels splitting.

Figure 14:
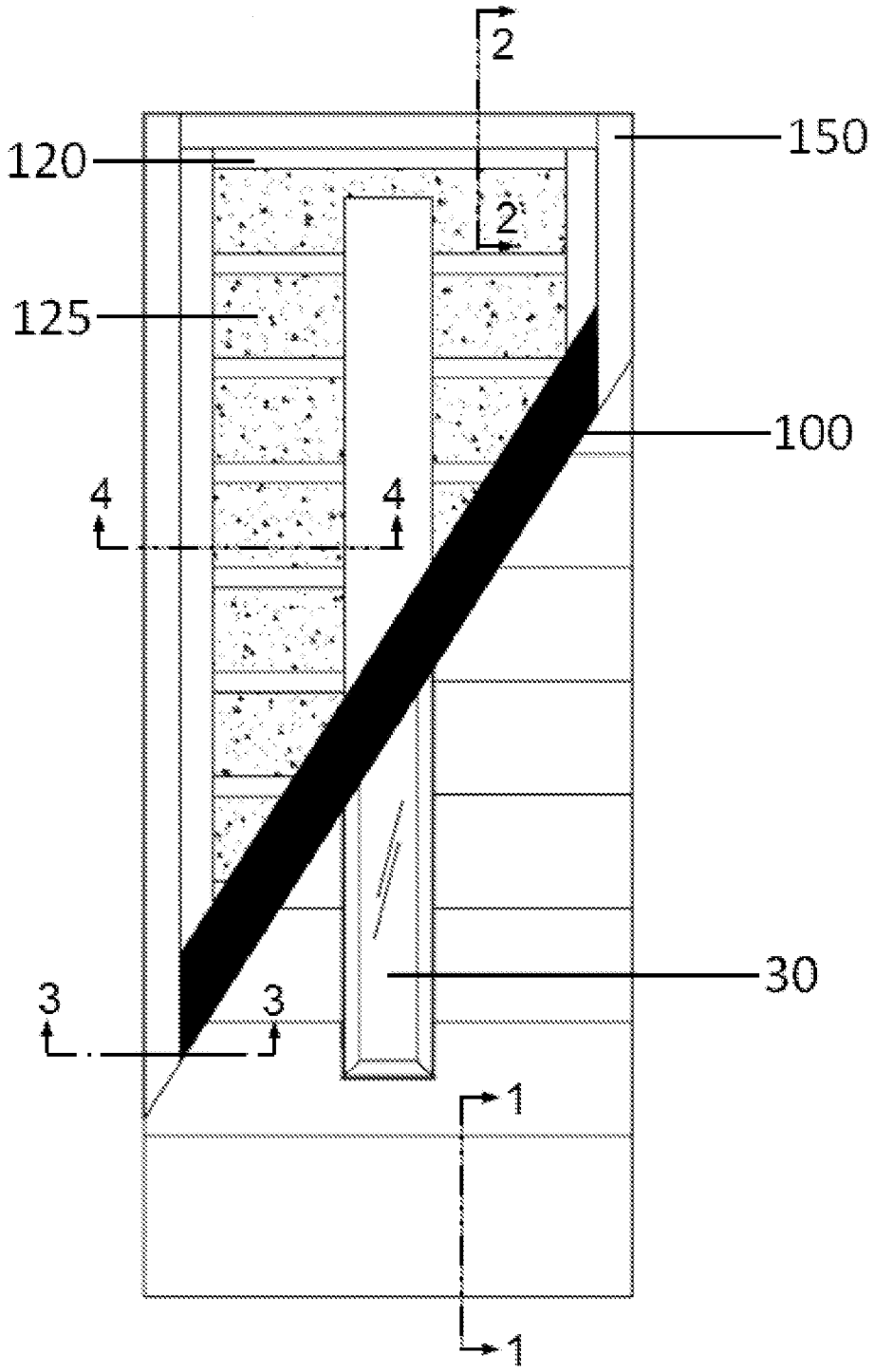
FIG. 14 is a cut-away front view of a door comprising the first embodiment with a Hamburg joint-less door design.
Figure 14A:
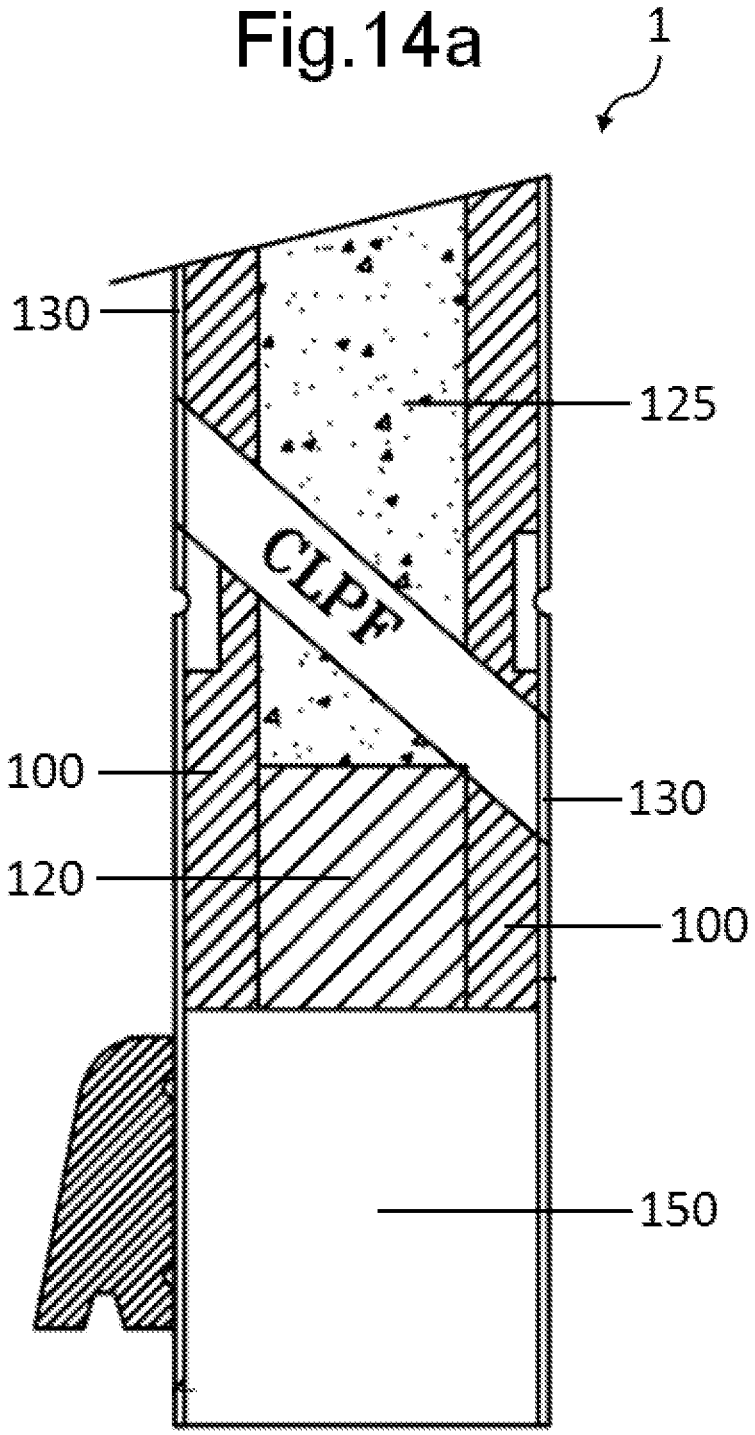
FIG. 14*a* is the cross-section 1 of a door shown in the embodiment of FIG. 14.
Figure 14B:
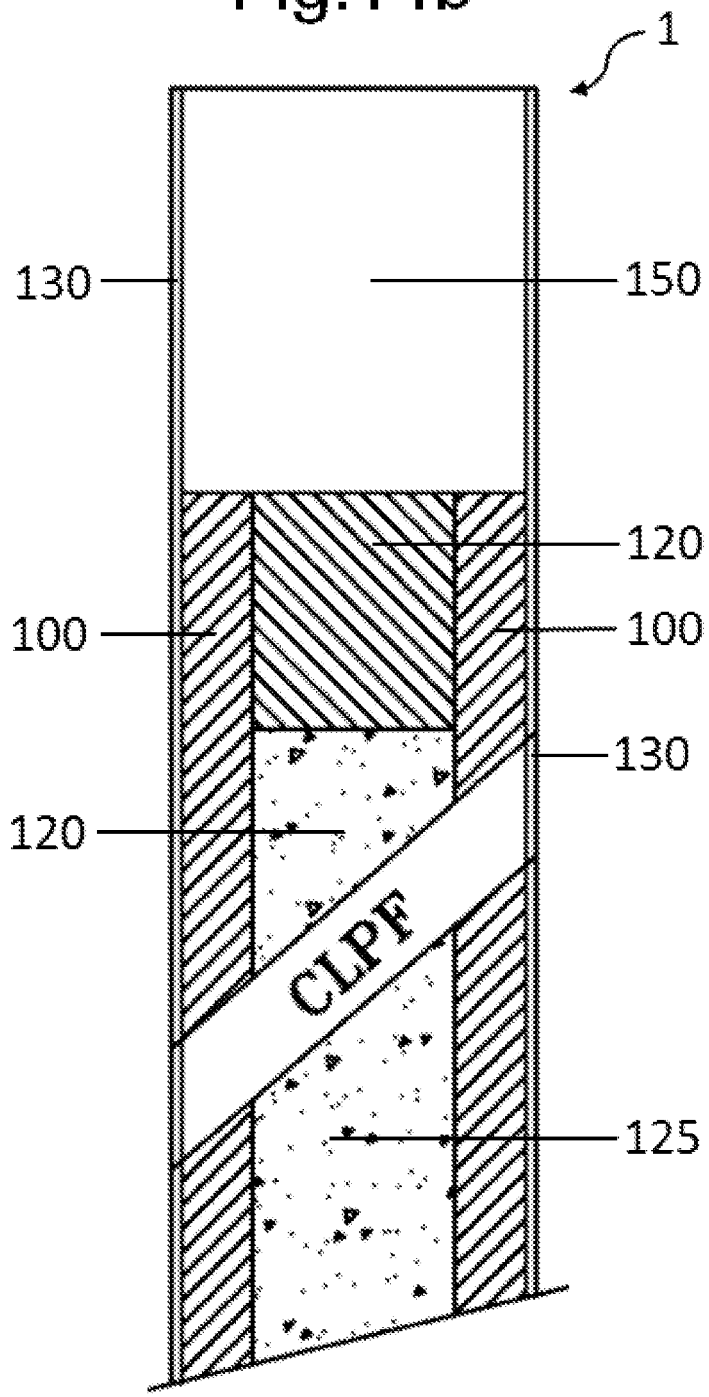
FIG. 14*b* is the cross-section 2 of a door shown in the embodiment of FIG. 14.
Figure 14C:
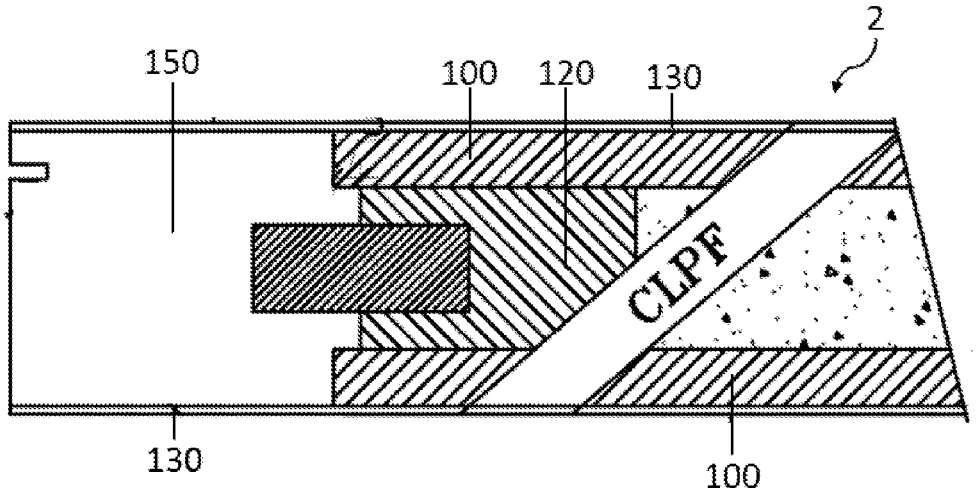
FIG. 14*c* is the cross-section 3 shown in the embodiment of FIG. 14.
Figure 14D:
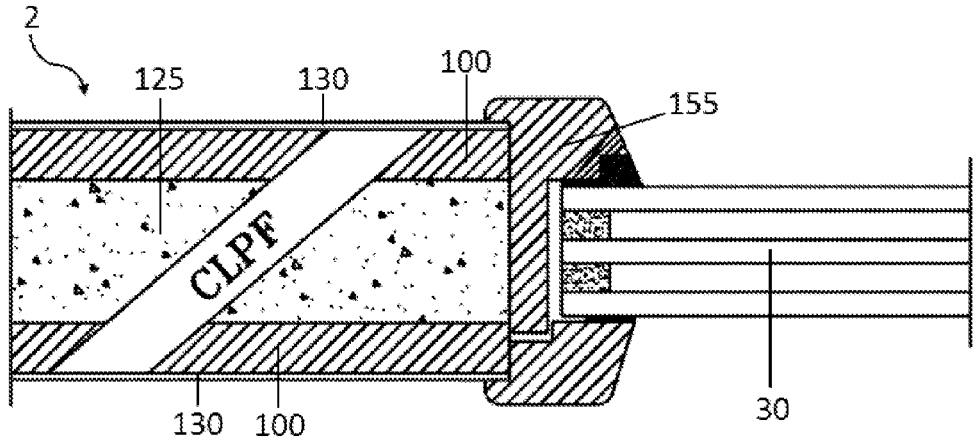
FIG. 14*d* is the cross-section 4 of a door shown in the embodiment of FIG. 14.

This is as shown in the Hamburg joint-less door in FIG. 14 where CNC machining may be used preferably to provide a central opening where a glass panel 30 is secured therein. This type of door may be designed for plank doors with a glass opening. FIG. 14*a* shows the cross-section 1 view of a bottom rail 1 of the door 20 shown in the embodiment of FIG. 14. FIG. 14*b* shows the cross-section 2 of a top rail 1 of the door 20 shown in the embodiment of FIG. 14. FIG. 14*c* shows the cross-section 3 of a stile 2 of the door 20 shown in the embodiment of FIG. 14. Finally, FIG. 14*d* shows the cross-section 4 of a stile 2 and a glass panel 30 of the door 20 shown in the embodiment of FIG. 14.

Figure 15:
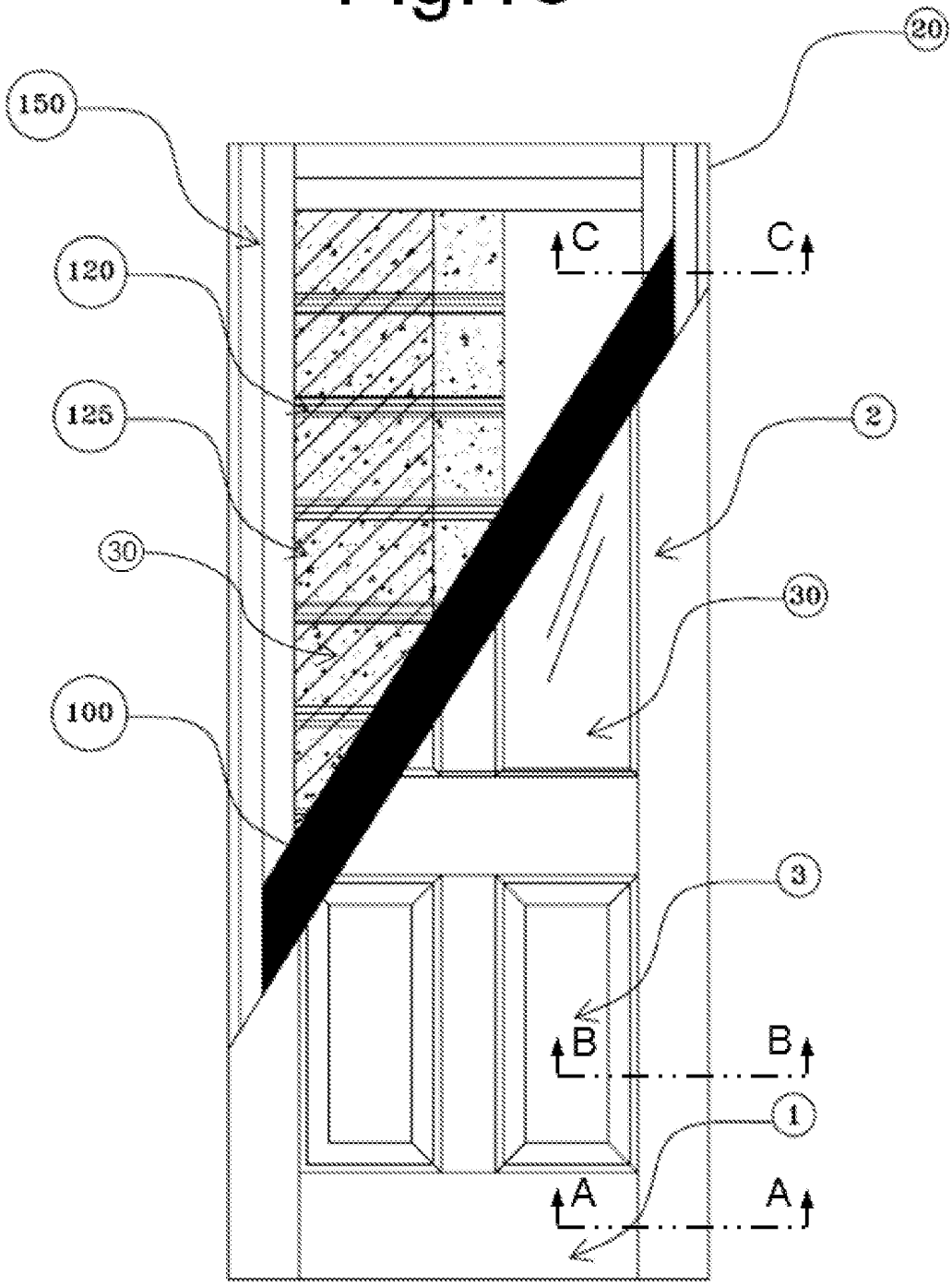
FIG. 15 is a cut-away front view of a door comprising the first embodiment with a Derby joint-less door design.
Figure 15A:
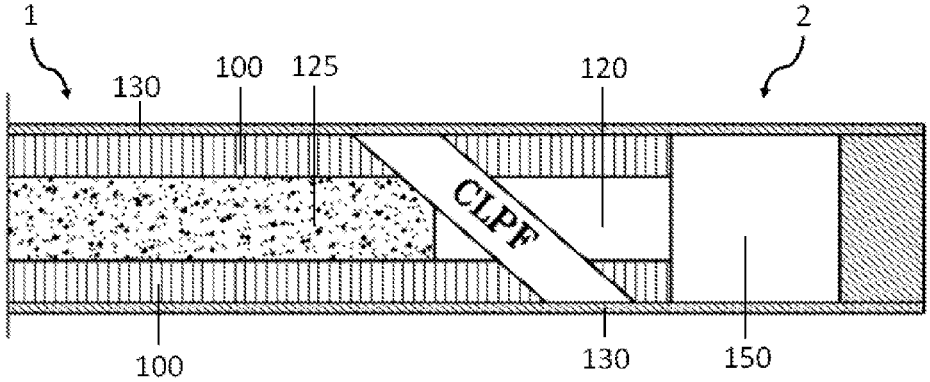
FIG. 15*a* is the cross-section A-A of a door shown in the embodiment of FIG. 15.
Figure 15B:
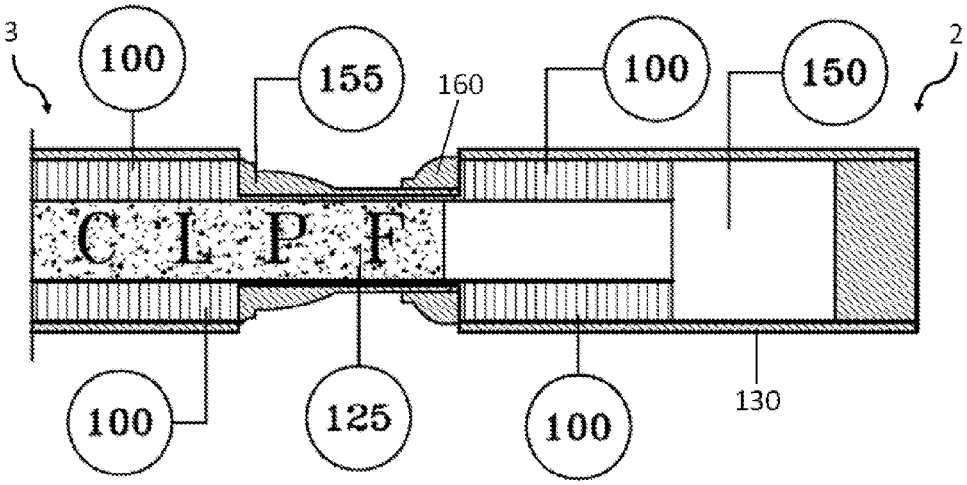
FIG. 15*b* is the cross-section B-B of a door shown in the embodiment of FIG. 15.
Figure 15C:
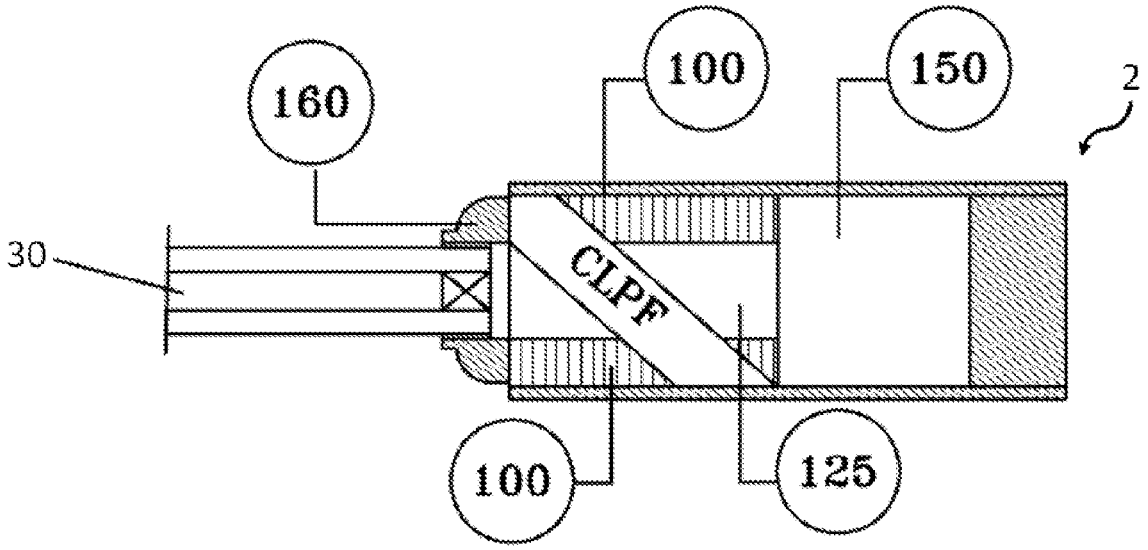
FIG. 15*c* is the cross-section C-C of a door shown in the embodiment of FIG. 15.

Equally, a Derby joint-less door is shown in the embodiment of FIG. 15 where CNC machining may be used preferably to provide panels 3 and openings where glass panels 30 are secured therein. FIG. 15*a* shows the cross-section A-A of a bottom rail 1 and a stile 2 of the door 20 shown in the embodiment of FIG. 15. FIG. 15*b* shows the cross-section B-B of a stile 2 and a panel 3 of the door 20 shown in the embodiment of FIG. 15. Preferably, CNC machining can take out part of the outer boards 100 to allow a decorative surface 160. Finally, FIG. 15*c* shows the cross-section C-C of a stile 2 and a glass panel 30 of the door 20 shown in the embodiment of FIG. 15.

Figure 16:
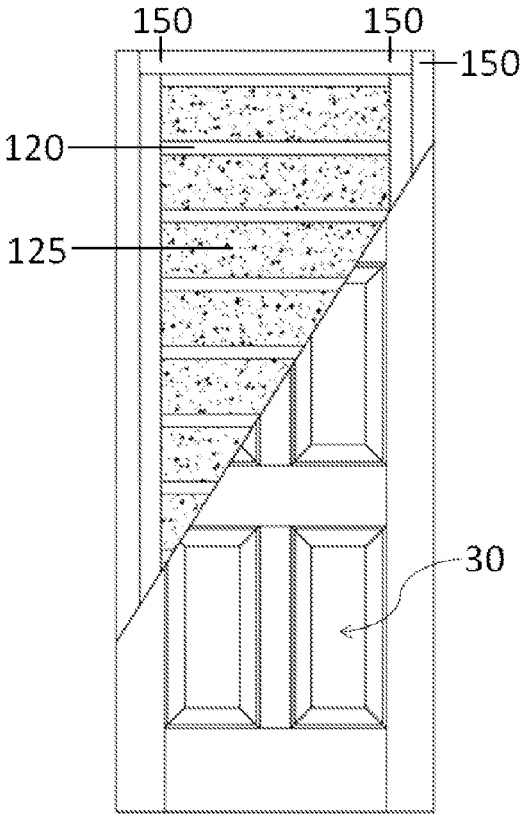
FIG. 16 is a cut-away front view of a Colonial 6 panel joint-less door design.
Figure 17:
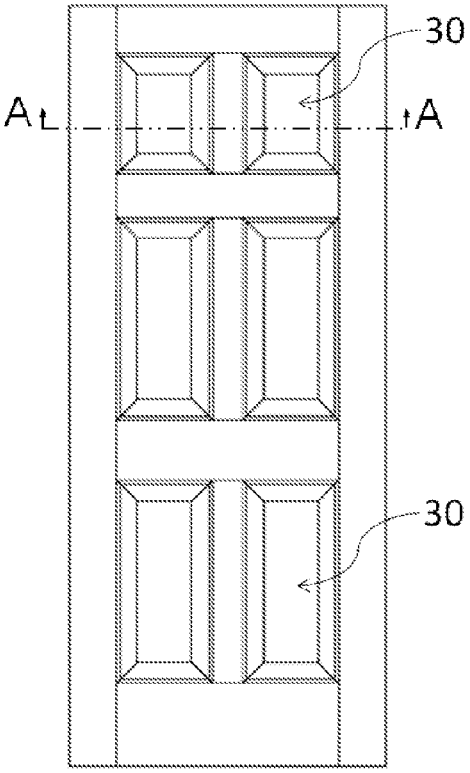
FIG. 17 is a front view of the door design of FIG. 16.
Figure 18:
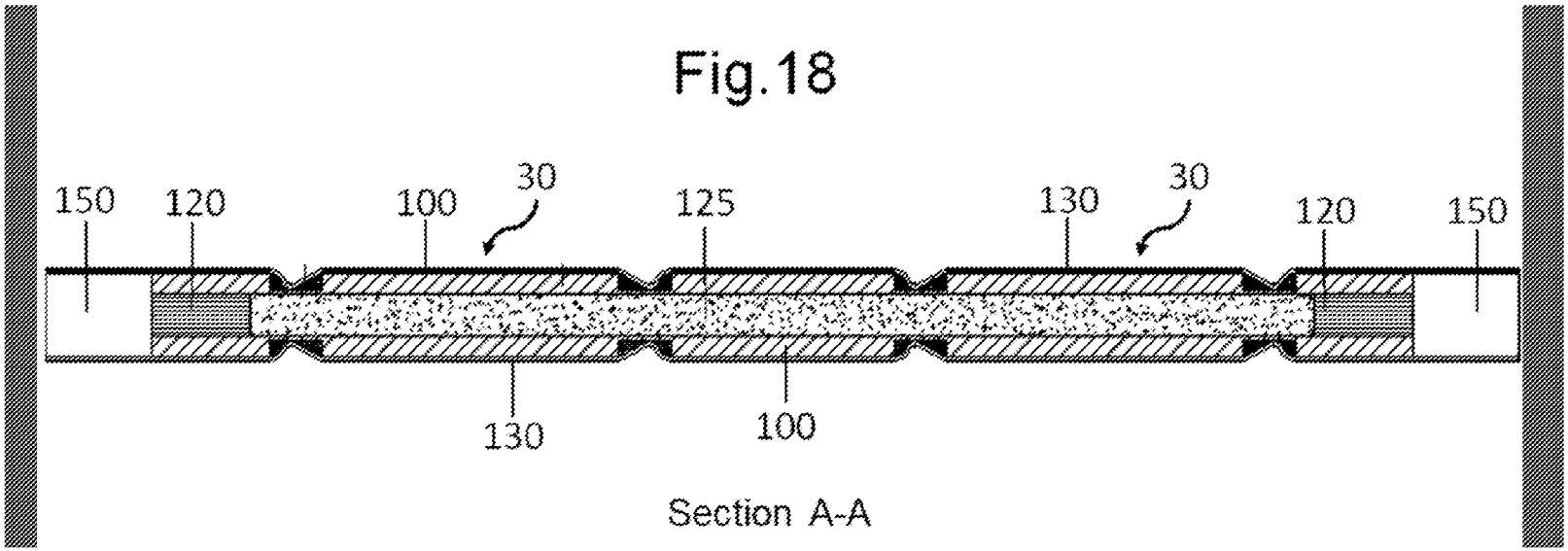
FIG. 18 is the cross-section A-A of the door shown in FIG. 17.

FIGS. 16 to 18 show another embodiment of the present invention. Another joint-less door concept is manufactured following the method shown in FIG. 11 which has been applied to construct the doors described forth above. However, unlike e.g., FIG. 11, the inner door component 10 (shown in FIG. 16) is bounded by at least two skins 130 made of GRP (Glass-Reinforced Plastic) (shown in FIG. 18) that improve the strength and hence the security of the door 20. This type of door may be designed for maintenance free entrance doors.

It will be appreciated that by varying the thickness of the insulating foam layer, a door can have different thickness which will be understood to improve thermal insulation while ensuring enhanced structural integrity and security.

The present invention is not limited to the specific embodiments described above and it will be understood that features disclosed as part of one embodiment can, if appropriate, be used in combination with other embodiments. Alternative arrangements and suitable materials will be apparent to a reader skilled in the art. Thus, the present invention may be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A door component, comprising:

at least one thermally insulating block sandwiched between a first layer and a second layer; wherein the first layer and the second layer comprise cross-laminated plywood;

wherein the first layer has a plurality of laminate sublayers that are stacked relative to each other in a first laminate stacking direction;

wherein the second layer has a plurality of laminate sublayers that are stacked relative to each other in a second laminate stacking direction;

a plurality of strengthening bars sandwiched between the first and second layers, including a first strengthening bar and a second strengthening bar; wherein the strengthening bars are formed of Laminated Veneer Lumber (LVL); wherein the first strengthening bar has a plurality of laminate sublayers that are stacked relative to each other in a third laminate stacking direction;

wherein the thermally insulating block is:

bounded on a first side by the first strengthening bar;

bounded on a second side, opposite the first side, by the second strengthening bar;

bounded on a third side, disposed between the first and second sides, by the first layer;

bounded on a fourth side, disposed between the first and second sides and opposite the third side, by the second layer;

wherein the first laminate stacking direction and the second laminate stacking direction are parallel to each other; and wherein the third laminate stacking direction is perpendicular to the first and second laminate stacking directions.

2. The door component of claim 1, wherein the thermally insulating material is a foam material.

3. The door component of claim 1:

wherein the at least one thermally insulating block comprises a plurality of elongate blocks arranged substantially parallel to one another in spaced relation to each other;

wherein adjacent blocks are separated from one another by at least one intervening strengthening bar.

4. The door component of claim 3:

wherein each of the plurality of elongate blocks extends continuously from a position adjacent a first edge of the door component to a position adjacent a second edge of the door component;

wherein the first edge is opposite the second edge.

5. The door component of claim 3, wherein at least one of the plurality of elongate blocks has a uniform cross-sectional size and shape along the entire length of the block.

6. The door component of claim 3, wherein each of the plurality of elongate blocks has an interference fit with the first and second layers.

7. The door component of claim 3, wherein each of the plurality of elongate blocks is compressed by the first and second layers.

8. The door component of claim 1, further comprising first and second decorative layers outwardly covering the first and second layers, respectively.

9. A door, comprising:

a door core; wherein the door core comprises:

at least one thermally insulating block sandwiched between a first layer and a second layer; wherein the first layer and the second layer comprise cross-laminated plywood;

wherein the first layer has a plurality of laminate sublayers that are stacked relative to each other in a first laminate stacking direction;

wherein the second layer has a plurality of laminate sublayers that are stacked relative to each other in a second laminate stacking direction;

a plurality of strengthening bars sandwiched between the first and second layers, including a first strengthening bar and a second strengthening bar; wherein the strengthening bars are formed of Laminated Veneer Lumber (LVL); wherein the first strengthening bar has a plurality of laminate sublayers that are stacked relative to each other in a third laminate stacking direction;

wherein the thermally insulating block is:

bounded on a first side by the first strengthening bar;

bounded on a second side, opposite the first side, by the second strengthening bar;

bounded on a third side, disposed between the first and second sides, by the first layer;

bounded on a fourth side, disposed between the first and second sides and opposite the third side, by the second layer;

wherein the first laminate stacking direction and the second laminate stacking direction are parallel to each other; and wherein the third laminate stacking direction is perpendicular to the first and second laminate stacking directions;

a framing bezel mounted to the core and disposed so as surround a perimeter of the door core.

10. The door of claim 9, wherein the framing bezel is formed of wood.

11. The door component of claim 1, wherein the plurality of laminate sublayers of the first strengthening bar each have both a first end face that faces the first layer and a second end face that faces the second layer.

12. The door of claim 9, wherein the plurality of the laminate sublayers of the first strengthening bar each have both a first end face that faces the first layer and a second end face that faces the second layer.

* * * * *